US007871292B1

(12) United States Patent
Hu

(10) Patent No.: US 7,871,292 B1
(45) Date of Patent: Jan. 18, 2011

(54) POWER ADAPTER PROVIDED LINE WINDING

(75) Inventor: Jen-Yao Hu, Tainan County (TW)

(73) Assignee: Innotrans Technology Co., Ltd., Taipei (TW)

( * ) Notice: Subject to any disclaimer, the term of this patent is extended or adjusted under 35 U.S.C. 154(b) by 0 days.

(21) Appl. No.: 12/652,506

(22) Filed: Jan. 5, 2010

(51) Int. Cl.
*H01R 13/72* (2006.01)

(52) U.S. Cl. ..... 439/501

(58) Field of Classification Search ..... 439/501; 191/12.4; 242/371
See application file for complete search history.

(56) References Cited

U.S. PATENT DOCUMENTS

| | | | | |
|---|---|---|---|---|
| 5,984,717 | A * | 11/1999 | Lee | 439/501 |
| 6,402,546 | B1 * | 6/2002 | Groves et al. | 439/501 |
| 6,573,617 | B2 * | 6/2003 | Jones et al. | 307/36 |
| 6,604,960 | B2 * | 8/2003 | Liu | 439/501 |
| 6,960,727 | B2 * | 11/2005 | Hering | 174/135 |
| 7,035,126 | B1 * | 4/2006 | Lanni | 363/142 |
| 7,658,625 | B2 * | 2/2010 | Jubelirer et al. | 439/131 |
| 2002/0106934 | A1 * | 8/2002 | Bean | 439/501 |
| 2010/0068920 | A1 * | 3/2010 | Shen et al. | 439/501 |
| 2010/0084236 | A1 * | 4/2010 | Yang | 191/12.4 |
| 2010/0139950 | A1 * | 6/2010 | Chen | 174/135 |

FOREIGN PATENT DOCUMENTS

| | | |
|---|---|---|
| TW | 529822 | 4/2003 |
| TW | M299946 | 10/2006 |
| TW | M350899 | 2/2009 |

* cited by examiner

*Primary Examiner*—Gary F. Paumen
(74) *Attorney, Agent, or Firm*—Muncy, Geissler, Olds & Lowe, PLLC

(57) ABSTRACT

A power adapter equipped with line winding function comprises an adapter body and a line winding means. The adapter body includes a housing and a conversion circuit held in the housing. The housing has a coupling side substantially in parallel with the conversion circuit. The coupling side includes at least one first coupling portion. The line winding means includes a first conducting line end and a second conducting line end that are extensible or retractable and electrically connected. The first conducting line end is extended into the housing to form electric connection with the conversion circuit. Hence the first conducting line end can transfer electric power from the conversion circuit to the second conducting line end. The line winding means further has at least one second coupling portion which is separable or latchable with the first coupling portion through forces. By coupling of the first and second coupling portions the line winding means can be coupled on the coupling side so that the adapter body and the line winding means are coupled to become a portable power adapter.

6 Claims, 6 Drawing Sheets

POWER ADAPTER PROVIDED LINE WINDING

FIELD OF THE INVENTION

The present invention relates to a power adapter equipped with line winding function to extend or retract a conducting line.

BACKGROUND OF THE INVENTION

These days information products are widely used in the society. Adapters are commonly adopted to mate all types of electronic devices to provide stable electric power. The conventional adapter includes an input end and an output end, such as one disclosed in R.O.C. patent gazette No. 529822 entitled "Power adapter equipped with a power indication light." It is made at a size and shape to make carrying easier to be sold or carried with electronic products. It also has a power cord that can be bundled to facilitate storing. However, line retraction often is a problem on the general power adapter. To resolve the problem of line retraction R.O.C. patent No. M350899 entitled "Power adapter equipped with unit winding" proposes a structure in which a line winder (winding disc, helical spring or the like) is provided between an upper housing and a lower housing of the power adapter in addition to circuit elements to retract the conducting line. While the power adapter thus formed can keep the exterior neat and tidy, and also provide line winding function, the interior space is limited and a cooling space is needed. The line winder hinders air circulation inside and cooling power of the adapter suffers. Moreover, the adapter of a greater power contains more voluminous circuit elements and requires a larger insulation space. Hence having a built-in line winder in a large capacity adapter is not advisable.

In order to free the line winder from occupying the interior space of the adapter other techniques have been proposed. For instance, R.O.C. patent No. M299946 entitled "Concealable and extensible power adapter plug" discloses a power adapter containing a concealable and extensible plug, and also including a line winder to wind a conducting line at another end of the adapter. Although the line winder is located outside the power adapter without occupying the interior space needed for cooling and holding circuit elements, there is no holding place to hold line winder. The line winder is dangling and entangling outside the power adapter. Hence it offers no much improvement in usability than the conventional practice of carrying separated power adapter and line winder.

Moreover, most portable information products rely on the power adapter as power source. Its size and shape become important issues of portability. The commonly seen power adapter is formed in a rectangular shape. Including a line winder in the longitudinal direction of the power adapter creates a voluminous visual impression. Hence there are still rooms for improvement, especially in terms of anchoring the line winder on the power adapter and laying position.

SUMMARY OF THE INVENTION

In view of the disadvantages of the aforesaid conventional techniques that do not offer desired anchoring between the power adapter and line winder, and still leave a lot to be desired in usability, the primary object of the present invention is to provide a movable coupling structure for a power adapter and a line winder that allows them to be separated or coupled together.

The present invention provides a power adapter equipped with line winding function that comprises an adapter body and a line winding means. The adapter body includes a housing and a conversion circuit held in the housing. The housing has a coupling side substantially in parallel with the conversion circuit. The coupling side has at least one first coupling portion. The line winding means includes a first conducting line end and a second conducting line end that are extensible and retractable and connected electrically. The first conducting line end is extended into the housing to connect electrically to the conversion circuit so that electric power can be transferred from the conversion circuit through the first conducting line end to the second conducting line end. The line winding means further includes at least one second coupling portion separable or latchable with the first coupling portion under forces. Hence the line winding means can be coupled with the coupling side to make the adapter body and the line winding means engaged to become a portable power adapter.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
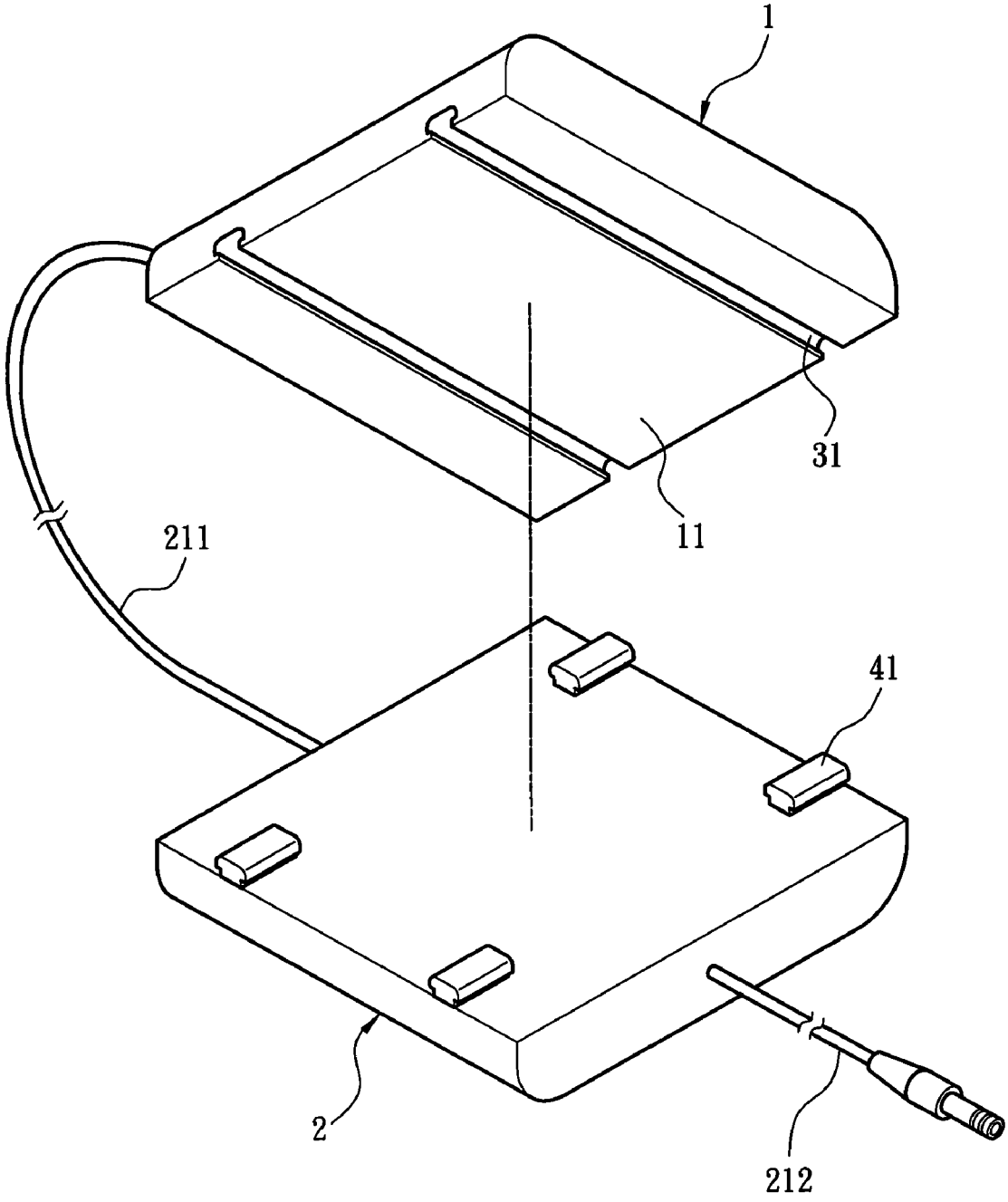
FIG. 1 is a perspective view of a first embodiment of the present invention.

The present invention aims to provide a power adapter equipped with line winding function. Please refer to FIG. 1 for a first embodiment of the invention. The power adapter comprises an adapter body 1 and a line winding means 2. The adapter body 1 includes a housing which has a housing space to hold a conversion circuit. The housing with the housing space to hold the conversion circuit is a technique known in the art, thus are not shown in details in the drawing. The line winding means 2 has a first conducting line end 211 and a second conducting line end 212 that are extensible and retractable by forces and electrically connected. The first conducting line end 211 is extended into the housing and anchored to connect electrically to the conversion circuit so that power can be transferred from the conversion circuit through the first conducting line end 211 to the second conducting line end 212. The first and second conducting line ends 211 and 212 are not necessary to be extended or retracted at the same time. The housing has a coupling side 11 substantially in parallel with the conversion circuit. The coupling side 11 has at least one first coupling portion 31. The line winding means 2 has at least one second coupling portion 41 corresponding to the first coupling portion 31, and the first and second coupling portions 31 and 41 are movable to be separated or latched together. By means of mutual latching of the first and second coupling portions 31 and 41 the line winding means 2 can be latched and anchored on the coupling side 11.

As shown in FIG. 1, the first and second coupling portions 31 and 41 may be a trough and a boss latchable with each other. They also can be formed respectively by injection molding on the adapter body 1 and the line winding means 2 in an integrated manner. As shown in FIG. 1, the first coupling portion 31 may further be formed in an elongate trough to allow the boss of the second coupling portion 41 to slide and latch thereon. By the mutual latching of the first and second coupling portions 31 and 41, the line winding means 2 can be coupled on the coupling side 11 to make the adapter body 1 and the line winding means 2 engaged to become a portable power adapter.

Figure 2:
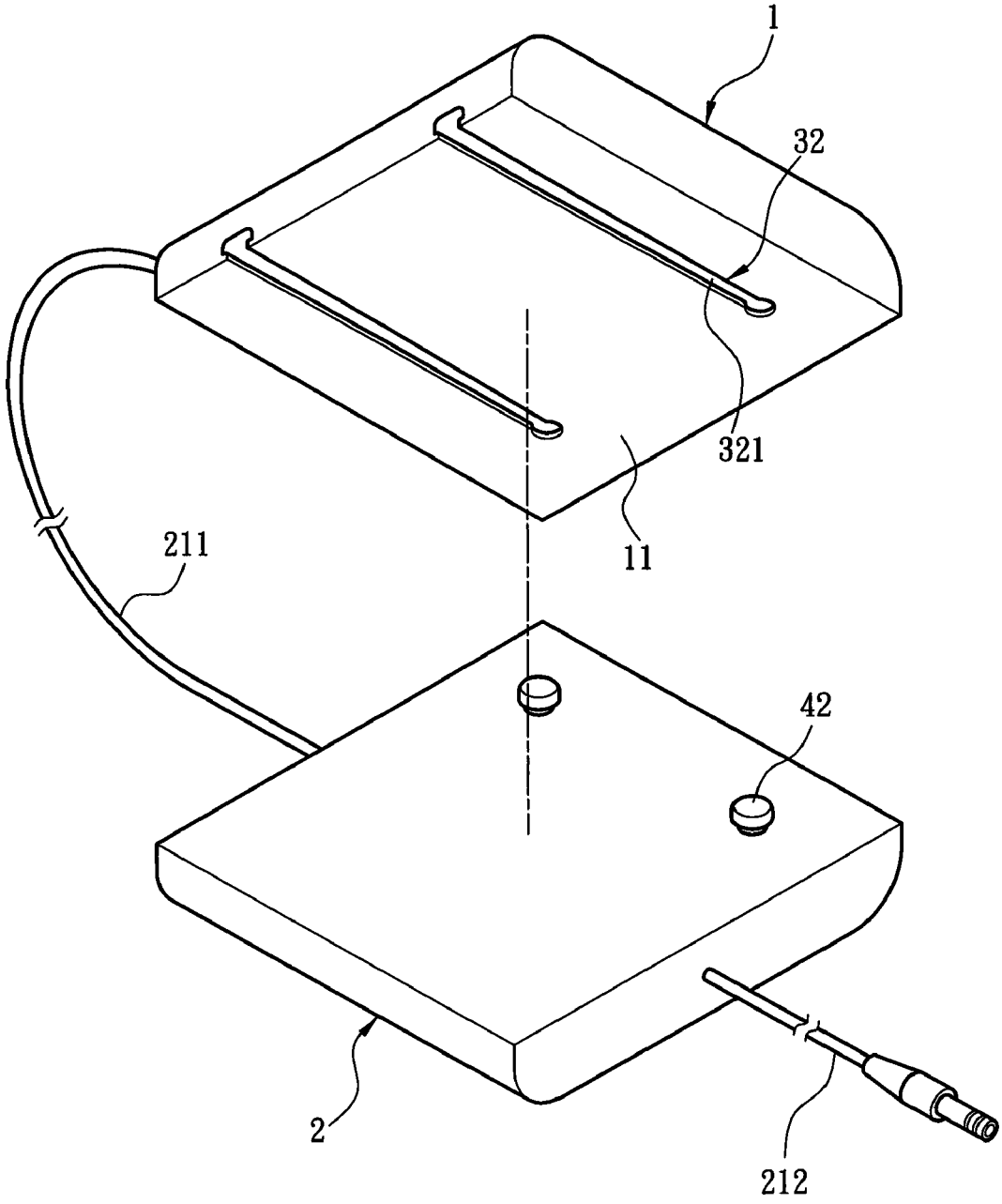
FIG. 2 is a perspective view of a second embodiment of the present invention.
Figure 3:
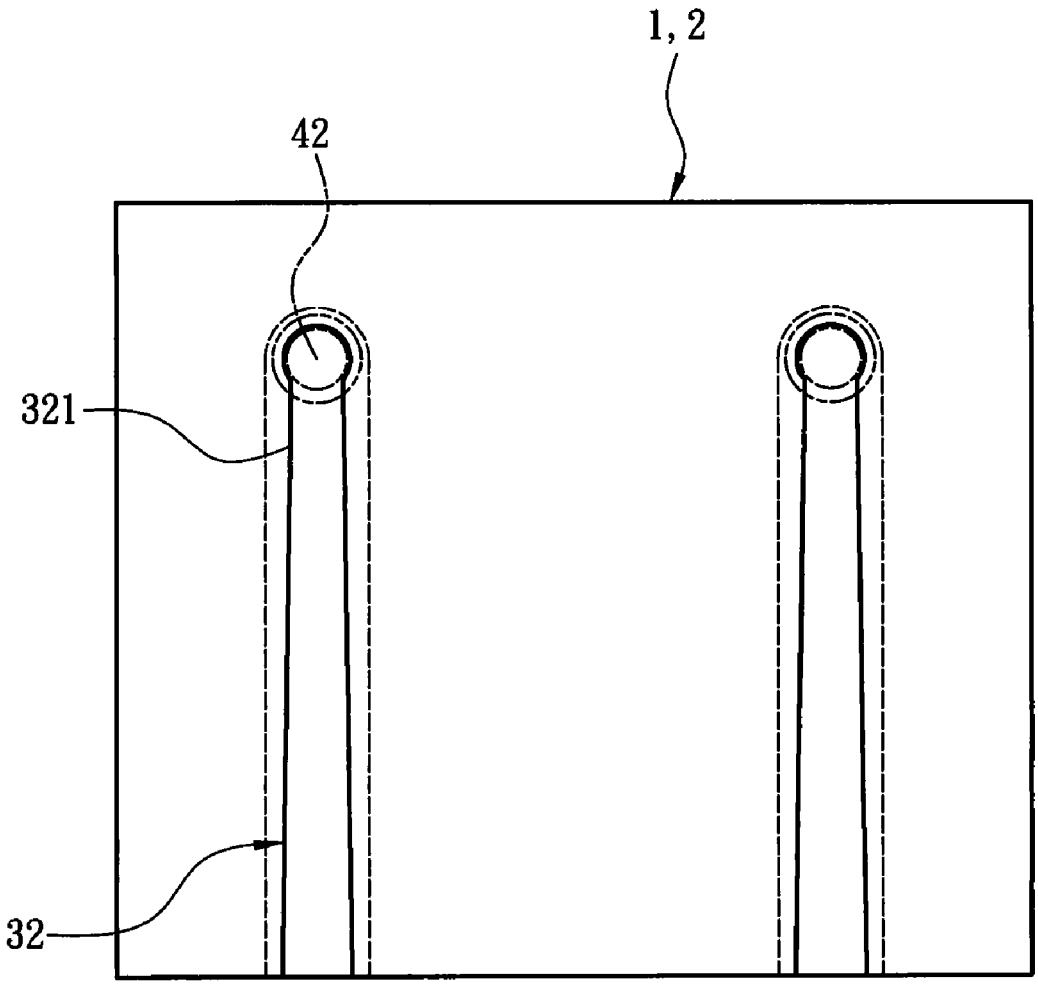
FIG. 3 is a schematic view of the second embodiment of the present invention in a coupled condition.

Refer to FIGS. 2 and 3 for another embodiment of the present invention. A first coupling portion 32 is formed in a trough on the housing with one opening at one side directing towards the coupling side 11. A second coupling portion 42 is formed in a strut as shown in FIG. 2. When the wire winding means 2 is winding the first conducting line end 211 the second coupling portion 42 is latched on the first coupling portion 32 through the opening and slides thereon as the first conducting line end 211 is wound. To prevent the adapter body 1 and the line winding means 2 from easily sliding away or loosening off a retaining structure is formed between the first and second coupling portions 32 and 42. Referring to FIG. 3, the trough has a retaining flange 321 which is spaced in a gradual shrinking manner from the opening to a distal end of the trough. The strut is clamped by the retaining flange 321 as it enters the trough from the opening. Thus after the line winding means 2 and the adapter body 1 are coupled together the retaining flange 321 can prevent the second coupling portion 42 from easily loosening off (namely prevent the line winding means 2 from escaping).

The retaining structure set forth above formed by shrinking the inner edge of the first coupling portion 32 can also be formed in other fashions to restrict mutual sliding of the adapter body 1 and the line winding means 2.

Figure 4:
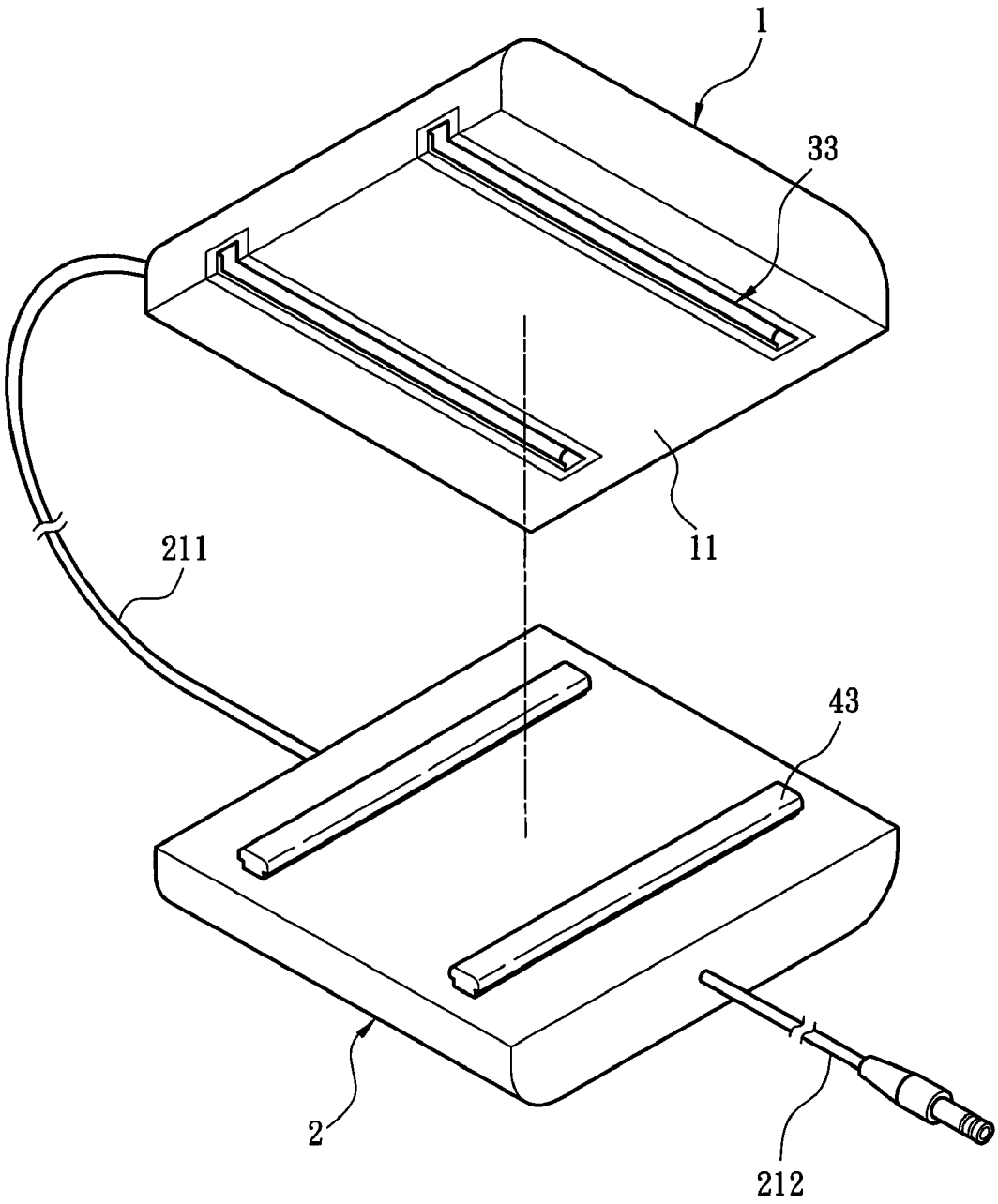
FIG. 4 is a perspective view of a third embodiment of the present invention.
Figure 5A:
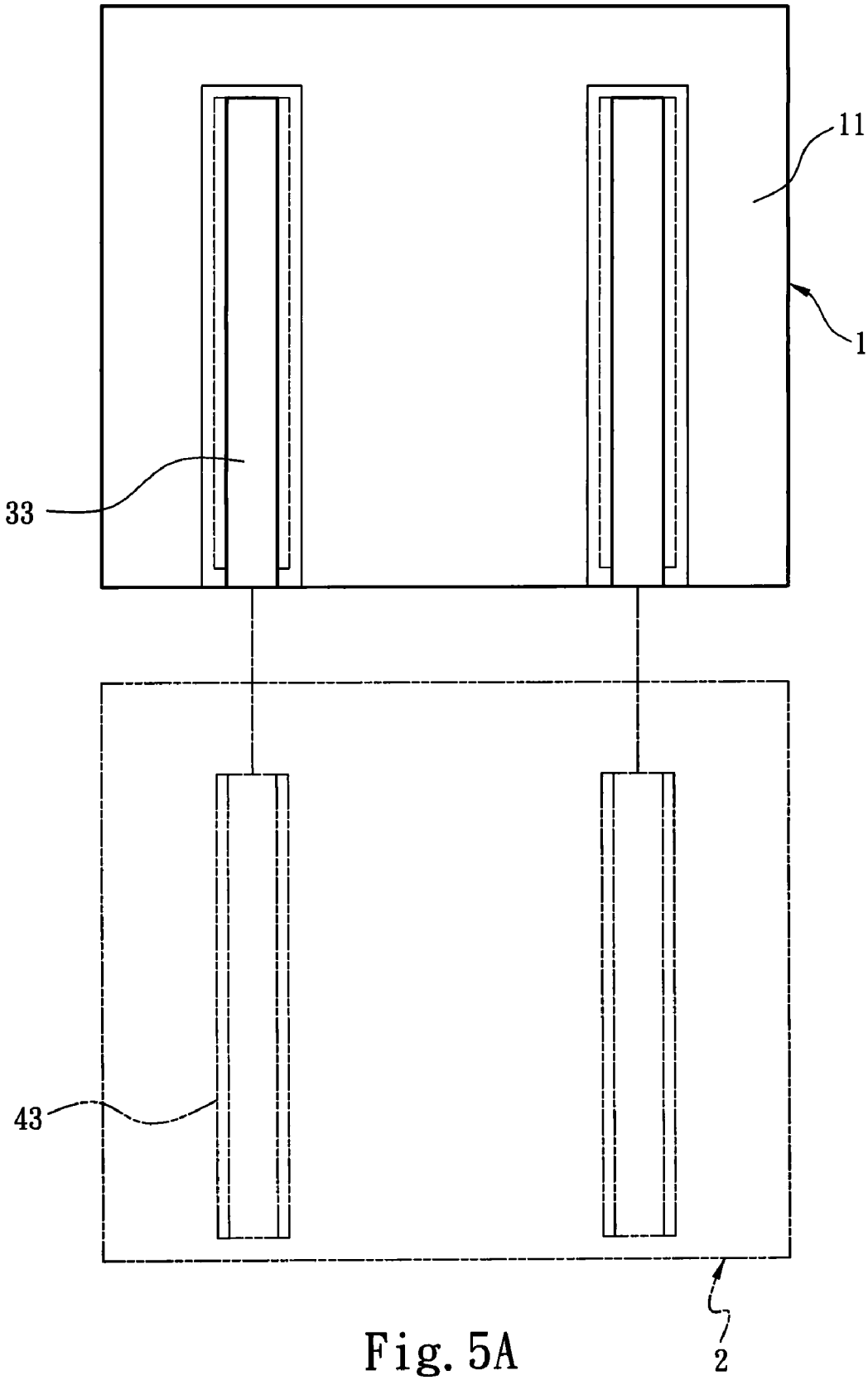
FIG. 5A is a schematic view of the third embodiment of the present invention in a separated condition.
Figure 5B:
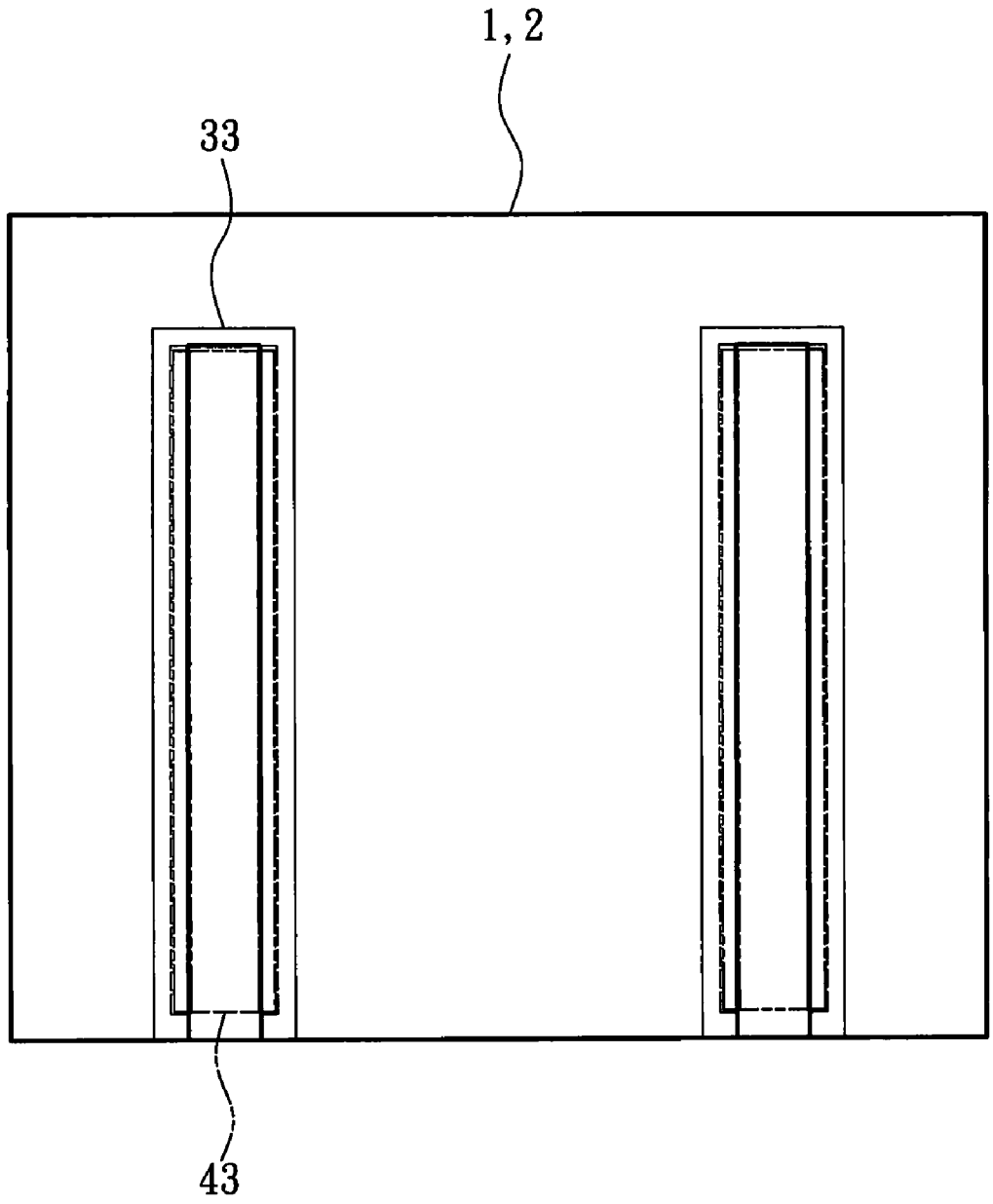
FIG. 5B is a schematic view of the third embodiment of the present invention in a coupled condition.

Refer to FIG. 4 for yet another embodiment of the adapter body 1 and the line winding means 2 that has a first coupling portion 33 and a second coupling portion 43 formed with a different retaining structure. The first and second coupling portions 33 and 43 are made from a flexible material. The first coupling portion 33 is substantially a trough, and the second coupling portion 43 is a boss corresponding to the trough to form latching therewith. The trough has an opening at one side of the housing formed at a size slightly smaller than the width of the boss. The trough is extended from one side of the housing towards the coupling side 11. When the first conducting line end 211 of the line winding means 2 is retracted, a force can be applied to the adapter body 1 and the line winding means 2. Through the flexibility of the trough and boss, the boss can be wedged forcefully through the smaller opening and slide into the trough (referring to FIGS. 5A and 5B). Thus unless the adapter body 1 and the line winding means 2 are forcefully and intentionally shaken or pulled, the opening of the trough can retain the boss without releasing easily. On the other hand, in the event that separation of the adapter body 1 and the line winding means 2 is desired, the boss can be removed from the trough by exerting a force thereon. In another aspect, the first or second conducting line ends 211 or 212 of the line winding means 2 can be pulled out to reach a sufficient length as required.

In the embodiments previously discussed, at least a portion of the first coupling portions 31, 32 and 33, and second coupling portions 41, 42 and 43 are made of metal, then cooling effect can be enhanced through them and a secure coupling also can be accomplished.

As a conclusion, the embodiments set forth above allow the adapter body 1 and the line winding means 2 to form movable coupling that allows the line winding means 2 to be coupled or separated as desired. By forming the first coupling portions 31, 32 or 33 on the coupling side 11 of the housing substantially in parallel with the conversion circuit held in the adapter body 1, and by mutual coupling of the first coupling portions 31, 32 and 33 and the second coupling portions 41, 42 and 43, the line winding means 2 is latched on the adapter body 1 substantially in parallel with the conversion circuit. Hence the total size of the line winding means 2 and adapter body 1 remains unchanged while the total length does not increase. Such a structure makes storing and carrying easier. Moreover, by using metal to form the first and second coupling portions 31, 32, 33 and 41, 42 and 43, improved cooling effect also can be achieved. Thus the present invention provides a significant improvement over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A power adapter provided line winding, comprising:

an adapter body which includes a housing and a conversion circuit, the housing containing a housing space to hold the conversion circuit and a coupling side substantially in parallel with the conversion circuit, the coupling side including at least one first coupling portion; and a line winding means which includes a first conducting line end and a second conducting line end that are extensible and retractable and electrically connected to each other, the first conducting line end being extended into the housing to form electric connection with the conversion circuit, the line winding means further including at least one second coupling portion separable or latchable with the first coupling portion through forces so that the line winding means is anchorable on the coupling side.

2. The power adapter of claim 1, wherein the line winding means extends or retracts the first conducting line end and the second conducting line end asynchronously.

3. The power adapter of claim 1, wherein the first coupling portion and the second coupling portion are respectively a trough and a boss latchable with each other.

4. The power adapter of claim 3, wherein the trough includes an opening on one side of the housing extended to the coupling side and contains a retaining flange spaced in a gradual shrinking manner from the opening to a distal end of the trough, the boss entering the trough through the opening and being clamped by the retaining flange.

5. The power adapter of claim 3, wherein the first coupling portion and the second coupling portion are made from a flexible material, the trough including an opening on one side of the housing that is smaller than the width of the boss and extended to the coupling side, the boss being wedged in the trough through forces and the flexibility thereof to form mutual latching.

6. The power adapter of claim 1, wherein the first coupling portion and the second coupling portion include at least a portion formed by heat conductive metal.

* * * * *